US006018978A

United States Patent [19]

Aniento

[11] Patent Number: 6,018,978

[45] Date of Patent: Feb. 1, 2000

[54] UNIVERSAL SIMPLIFIED RIVETER

[76] Inventor: Andres Perez Aniento, Robles, 32 28223 Pozuelo de Alarcon, Madrid, Spain

[21] Appl. No.: 09/029,756

[22] PCT Filed: Jun. 27, 1997

[86] PCT No.: PCT/ES97/00166

§ 371 Date: Mar. 2, 1998

§ 102(e) Date: Mar. 2, 1998

[87] PCT Pub. No.: WO98/09748

PCT Pub. Date: Mar. 12, 1998

[30] Foreign Application Priority Data

Sep. 3, 1996 [ES] Spain ..... 9601889

[51] Int. Cl.[7] ..... B21J 15/34

[52] U.S. Cl. ..... 72/391.4; 29/243.526

[58] Field of Search ..... 29/243.526, 243.521; 72/391.8, 391.4

[56] References Cited

U.S. PATENT DOCUMENTS

| | | | |
|---|---|---|---|
| 3,906,775 | 9/1975 | Benimetzki | 72/391.4 |
| 4,052,078 | 10/1977 | Benimetzki . | |
| 5,471,729 | 12/1995 | Zoltaszek . | |
| 5,544,401 | 8/1996 | Danino | 29/243.526 |

FOREIGN PATENT DOCUMENTS

| | | | |
|---|---|---|---|
| 0 027 663 | 4/1981 | European Pat. Off. . | |
| 0720877 | 7/1996 | European Pat. Off. . | |
| 221656 | 5/1985 | Germany | 29/243.526 |
| 2020087 | 7/1991 | Spain . | |
| 2073977 | 8/1995 | Spain . | |
| 91/11279 | 8/1991 | WIPO | 29/243.526 |

*Primary Examiner*—David Jones
*Attorney, Agent, or Firm*—M.H. Sears Law Firm; Thomas S. Hahn

[57] ABSTRACT

A universal simplified riveter, characterized by a telescopic housing consisting of two sliding pieces that are superposed so that it can be installed in a reversible drill of any brand, model, or shape, with said pieces being extended by covering the rotating part of the drill, thus protecting the hand of the operator when holding the riveter by its nonslip ergonomic exterior. Two design embodiments permit two ways of installation on the drill: in the chuck as a drill bit or over said drill bit without removing it.

5 Claims, 4 Drawing Sheets

UNIVERSAL SIMPLIFIED RIVETER

BACKGROUND OF THE INVENTION

Generally, in order to drive a rivet, one first needs a drill to make the hole for the rivet. The Universal Simplified Riveter uses the same drill for drilling either with electric power or with the batteries of the drill. It substitutes for the manually operated riveters of the pliers type that produce hand injuries due to the major effort required to drive the rivets. It is easy to use with two possible ways of installation in the drill: as a drill bit, or automatically above the drill bit, according to the two embodiments described. Thus in the riveting process: first, one makes the hole with the bit in the drill, and then one installs the riveter without removing the bit in order to rivet. The riveter is held with the hand once it is installed in the drill over a nonslip handle grip that also covers and protects the rotating part of the drill for maximum safety. The inside mechanism is dismantled without tools. Its use is quite useful when it is not possible to use pneumatic riveters, which are operated by compressed air, because a compressed air installation is not available or because it is inconvenient to have long compressed air-supply hoses when working at construction sites or outside the machine shop. At present, there is no small and simple tool for riveting with electric power.

SUBJECT MATTER OF THE INVENTION

In the description and drawings, the pieces are indicated by numbers and the highlighted parts of each piece are indicated by a number followed by a letter.

FIG. 1—Mandrel hollow rivet.

FIG. 2—Universal Simplified Riveter, in its embodiment as held in the drill as a drill bit, by means of its fluted cylindrical tip.

FIG. 3—First phase of installation in the chuck, as a drill bit.

FIG. 4—Second phase of tightening of the drill chuck.

FIG. 5—Universal Simplified Riveter in the embodiment as automatically secured over the drill bit.

FIG. 6—Automatic installation over the drill bit.

FIG. 7—Chuck of the key type and commercial drill bits with hexagonal tip (A), commercial screwdriver bits (B), and special bit adapter for transforming cylindrical drill bits (C) into hexagonal shank drill bits (A).

FIG. 8—Grasping the riveter and ensuring that the protector covers the chuck.

FIG. 9—Riveting by rotating the drill to the right.

FIG. 10—Expelling the residual mandrel by rotating the drill to the left.

FIG. 11—Housing (1) and (2) with the spring (3).

FIG. 12—Housing in two positions.

FIG. 13—Dismantling without tools of the grip mechanism of the riveter, by only unscrewing the nut (9) and exhibition box (51) whose cover can be folded and pulls out a piece of cardboard with perforations for rivets (51*a*) for testing and demonstrating riveting on said piece of cardboard.

FIG. 14—Assembly and disassembly of the riveter, with pieces in two views and cross section: (27) interchangeable nosepiece according to the sizes of rivets, consisting in a perforated screw with a cylindrical end, (9) cylindrical nut with a truncated-cone shape and with two female threads, (10) nut with hole shaped like a truncated cone, (11) jaw holder with interior shaped like a truncated cone, and thread and exterior shaped like a truncated cone and cylindrical, (12) three or two jaws shaped like a truncated cone with inside tines, (14) helicoidal conical spring, (17) spindle with external thread, hexagonal body (17*d*), cylindrical collar (17*c*), and external thread (17*e*), and with two separate internal cylindrical chambers (17*a*) and (17*b*), (19) helicoidal spring, (18) elastic washer for perforation, (29) elastic washer for a shaft, (24) washer with hexagonal and cylindrical exterior, (30) spherical balls, (22) washer with two interior diameters, (21) drive nut with cylindrical internal end (21*a*) and threaded internal end (21*e*) and exterior with longitudinal projections (21*b*), transversal groove (21*c*) and two diameters.

FIG. 15—Embodiment in which the drive nut (21) is replaced by the drive nut (32) with interior thread (32*b*) plus the magnetized internal hexagon (8) with external thread (8*b*) and hexagonal hole (8*a*).

FIG. 16—Drill bit adapter accessory for converting commercial cylindrical drill bits (C) (FIG. 7) into standard ¼-inch hexagonal shank drill bits (A) (FIG. 7), in order to install the Universal Simplified Riveter embodiment with the drive nut (32), in addition to over hexagonal-shank drill bits (A) or screwdriver bits (B) over any cylindrical-shank drill bit, automatically over the drill bit without removing it. The bit adapter comprises: (31) washer with two diametrical threaded holes, (28) ¼-inch hexagon (28*b*) with longitudinal hole and two transversal holes (28*a*), and two set screws (32).

FIG. 17—Complete riveter in the embodiment to be installed as a drill bit, with housing (1) and (2) cross-sectioned lengthwise and all its component pieces already described in longitudinal cross section: nut (9), nut (10), jaw holder (11), jaws (12), conical spring (14), spindle (17), elastic washer for the hole (18), spring (19), drive nut (21), two-diameter washer (22), hexagonal washer (24), interchangeable nosepiece (27), elastic washer for the shaft (29), and spheres (30).

FIG. 18—Complete riveter in the embodiment to be installed over an hex shank drill bit without removing it, in which the drive nut (21) is replaced by a drive nut (32) plus the magnetized hexagonal cavity (8).

DESCRIPTION OF PREFERRED EMBODIMENTS

Figure 1:
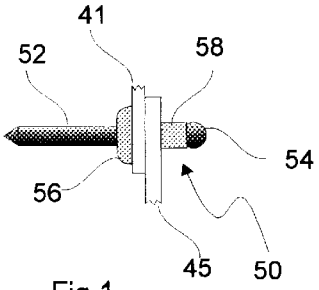
Figure 2:
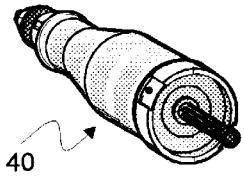

Referring now to the drawings, wherein corresponding components in the various figures are either designated by the same reference numerals or, if different reference numerals are used, their relationship is identified in the text.

Figure 3:
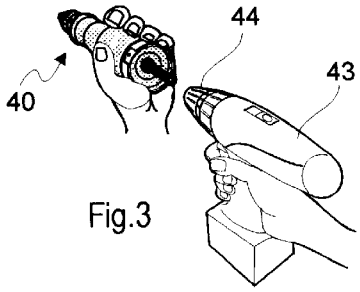
Figure 4:
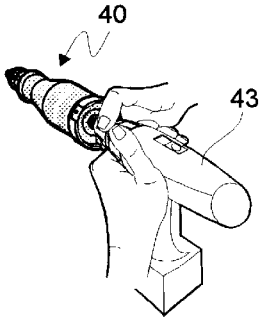
Figure 5:
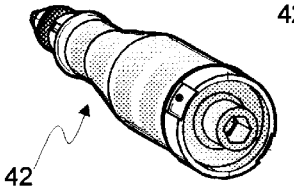
Figure 6:
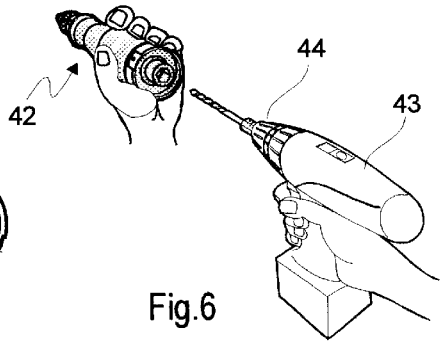
Figure 7:
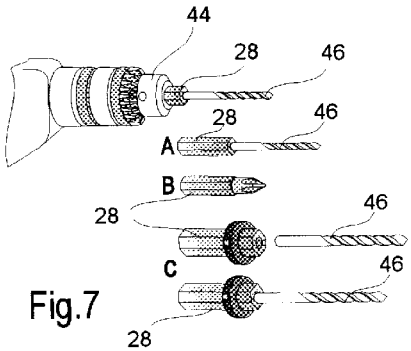
Figure 8:
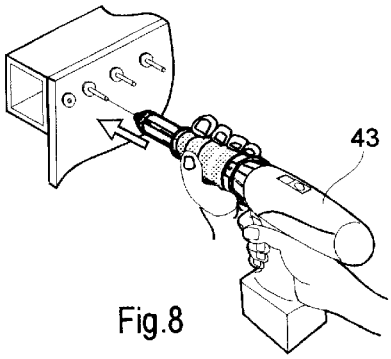
Figure 9:
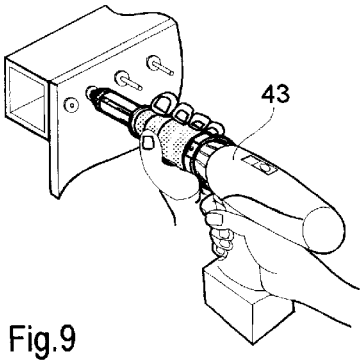
Figure 10:
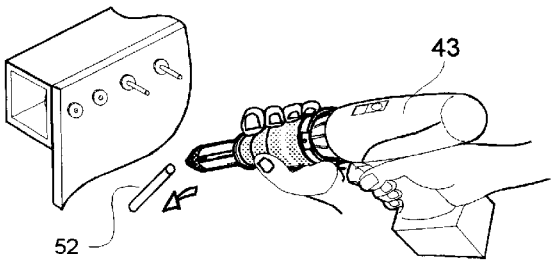

The invention is a universal riveter useable with reversible drill machines, and there are two preferred embodiments of the invention. The first embodiment, a universal riveter for use with a reversible drill machine is explicitly shown in FIGS. 2, 3, 4, 14 and 17 and it is generally designated by reference numeral 40. The second embodiment, a universal riveter for use with a reversible drill machine is explicitly shown in FIGS. 5, 6 and 18 and it is generally designated by reference numeral 42. As is discussed below the differences between the first embodiment for the universal riveter 40 of the invention and the second embodiment of the universal riveter 42 of the invention reside in the structures used for attachment to reversible drill machines 43. Both embodiments of the universal riveter invention are usable with electric or other auxiliary powered reversible drill machines 43 such as are known and generally shown in FIGS. 3 and 6.

Use of either embodiment of the invention involves first having a hole or holes made through the pieces to be riveted and then either embodiment of the universal riveter 40 or 42 is installed on a drill machine 43 to set rivets thereby avoiding manual work required by prior manual rivet setting tools and also providing protection for operator hands from injury.

Figure 11:
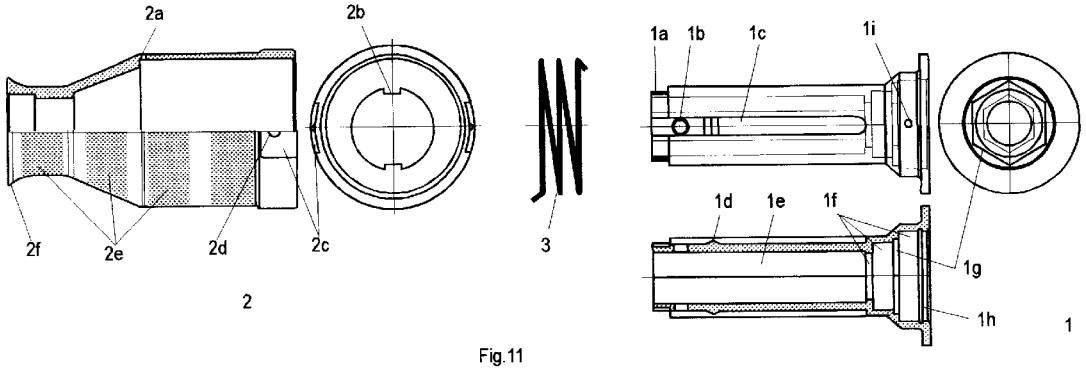
Figure 12:
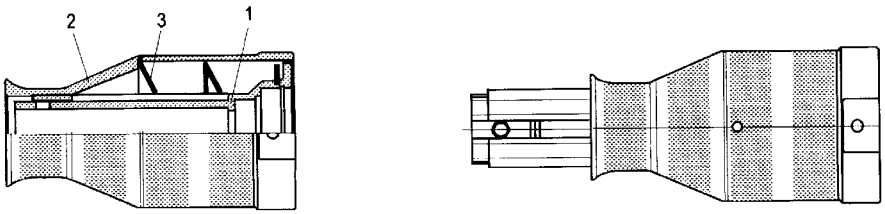

The first embodiment of the universal riveter 40 is attached to a drill chuck 44 (see FIGS. 3 and 4) as would be a drill bit or other tool to be turned with a drill chuck 44. First, the projections 2*b* of body 2 are shifted up the channels 1*c* of the housing 1 (see FIGS. 11 and 17) to uncover the longitudinal projection 21*b* of the drive nut 21 (see FIG. 14). With the body 2 so shifted, a drill chuck 44 is tightened onto the longitudinal projection 21*b* (see FIG. 4). The body 2 is then released so it can return by the force of spring 3 to cover the drill chuck 44 tightened over the longitudinal projection 21*b* (see FIGS. 11, 12 and 17). Body 2, as so repositioned over the drill chuck 44, provides a non-rotating hand-gripping surface to hold, support and direct the universal riveter 40 and thereby protects the operator's hands from injury that may be caused by rotating parts. The functioning and utility of body 2 are identical for both the universal riveter 40 embodiment and the universal riveter 42 embodiment of the invention.

Figure 17:
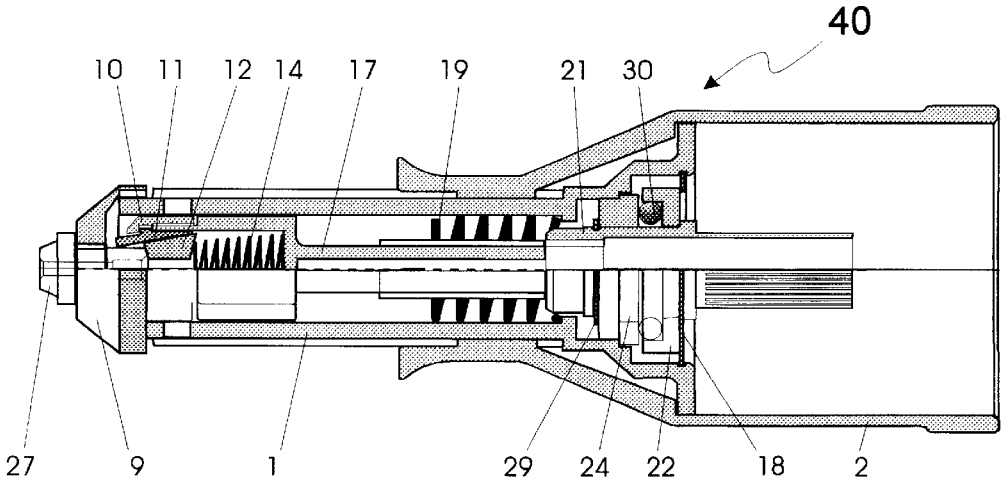
Figure 18:
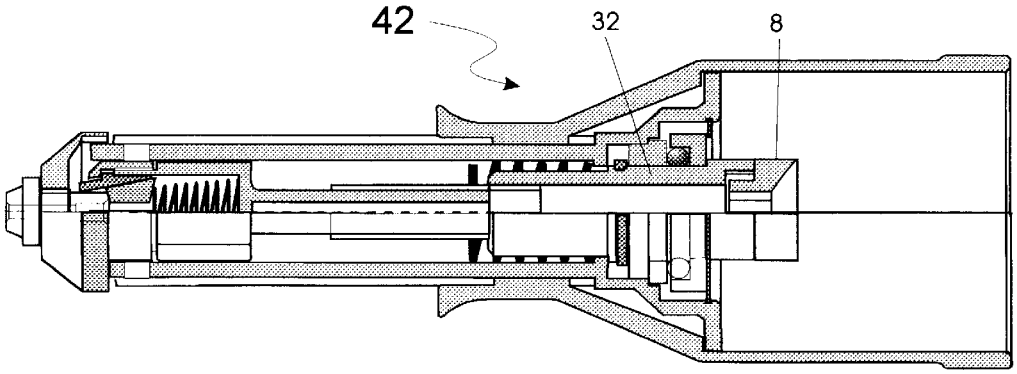

The parts of the universal riveter 40, including the internal parts, and their arrangements are shown in disassembled detail in FIG. 17. The configuration of the universal riveter 40 after it has been initially attached to a drill chuck 44 has the spindle 17 unthreaded by its threads 17*e* from the drive piece threads 21*e*. Additionally, at this time the nose piece 27 is positioned against and inside the jaws holder 11 pushing the jaws 12 into the major diameter of the truncated cone hole of the jaws holder 11 (see FIGS. 14 and 17). As so arranged the jaws 12 are kept open and the threads 17*e* of the spindle 17 are pressed against the mating threads 21*e*of the drive piece 21 by the force of helicoidal spring 19 (see FIG. 14).

Figure 13:
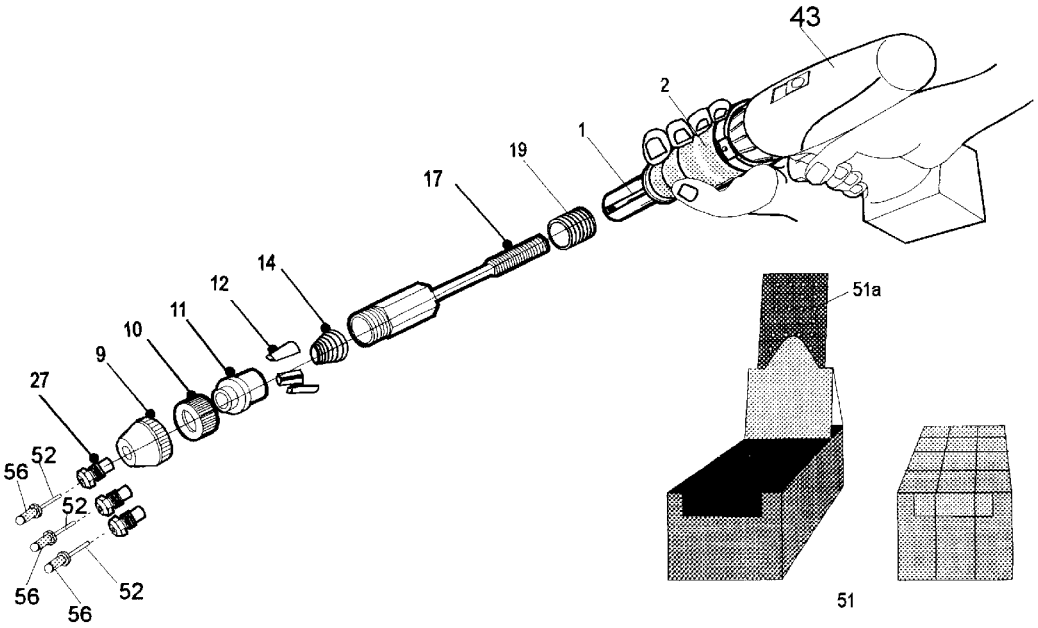
Figure 14:
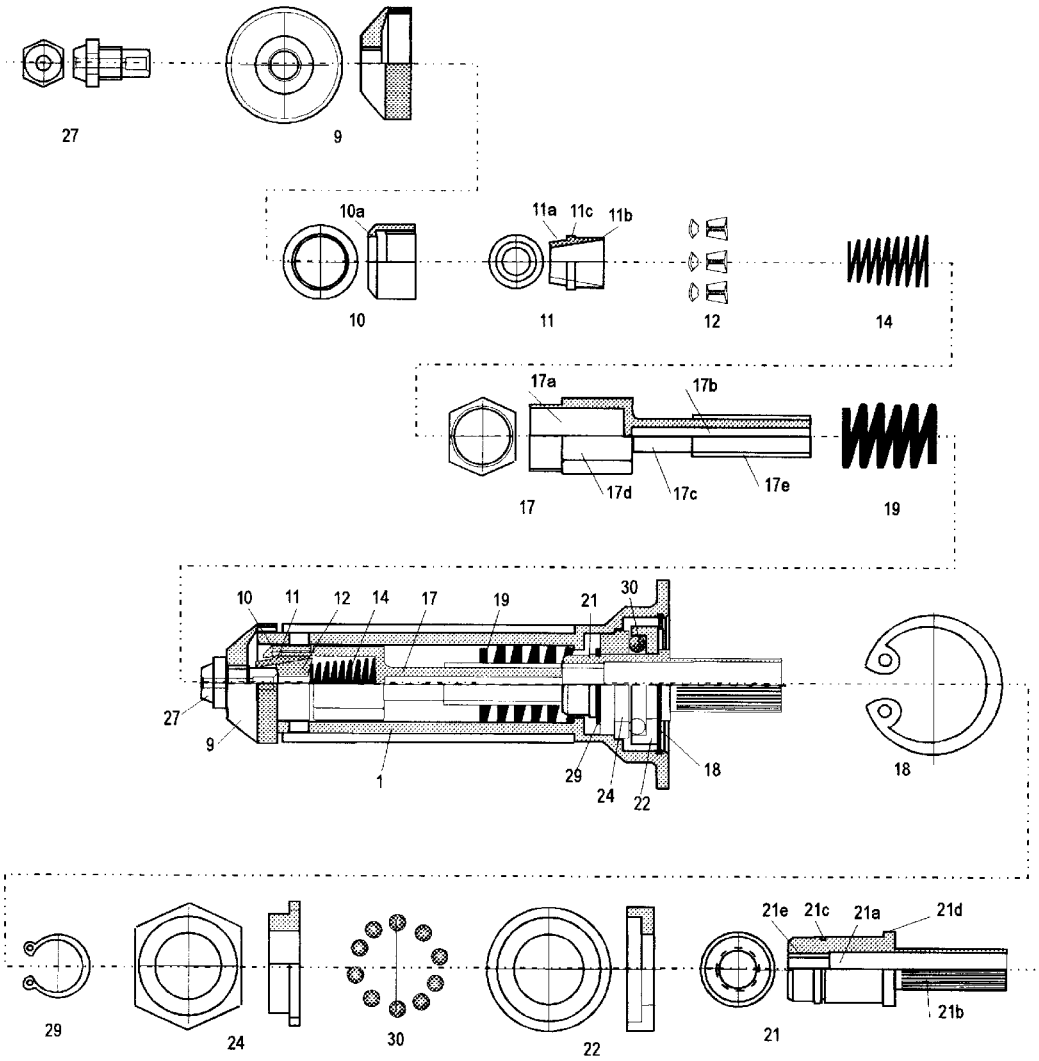

To use either the first or second embodiment of the universal riveter 40 or 42 a rivet mandrel 52 (FIGS. 1 and 13) is positioned in the opening of the nose piece 27 so as to be between the jaws 12 (see FIGS. 13 and 14). Now the rivet 50 (see FIGS. 1 and 13) is inserted into the hole previously formed through the pieces 41 and 45 (see FIG. 1) to be joined and the drill machine 43 is energized to turn the drill chuck 44, e.g., to the right, so that the drive piece 21 is turned. Thus turning the drive piece 21, which is supported by washer 22, hexagonal washer 24 and ball bearings 30, threads the drive piece 21 via threads 21*e*onto the threads 17*e* of spindle 17 and thereby axially moves the spindle 17 which is restrained from rotating by the hexagonal spindle body 17 that mates with the hexagonal housing 1*e* toward the drill machine 43 (see FIG. 14). This axial movement of the spindle 17 tightens the jaws 12 onto the rivet mandrel 52 (see FIG. 14), and then retracts the rivet mandrel 52 into the universal riveter 40 or 42 so that the first rivet wing 56 (see FIG. 1) moves against the end of nose piece 27 and the continued retraction of the rivet mandrel 52 toward the drill machine 43 causes the rivet ball head 54 to form a second rivet wing from the rivet sleeve 58 (see FIG. 1). After formation of the second wing the tensile strength of the rivet mandrel 52 is exceeded and the rivet mandrel 52 breaks. If the drill machine 43 is permitted to continue to turn the drill chuck 44 after the rivet mandrel 52 breaks, the spindle 17 will continue to be drawn into the universal riveter 40 until the spindle threads 17*e* are completely turned through the drive piece threads 21*e*. When the spindle threads 17*e* have been turned through the drive piece threads 2l*e* and the spindle threads 17*e* are in the drive piece cavity 21*a*, the helicoidal spring 19 is compressed thereby pushing the spindle threads 17*e* against the drive piece threads 21*e* so that both sets of threads can be reengaged when the direction of rotation of the drill chuck 44 is reversed.

The direction of the drill chuck 44 is now reversed, e.g. to the left, in order to release the rivet mandrel 52. The operator can continue to hold the body 2 with one hand during this reverse operation. When the drill chuck 44 is turned in the reverse direction the drive piece threads 21*e* are assisted in reengaging the spindle threads 17*e* by the force of the helicoidal spring 19 that had been compressed between spindle 17 and the interior wing of housing 1 (see FIG. 14). The rethreading of drive piece threads 21*e* and spindle threads 17*e* causes the spindle 17 to axially move in the opposite direction, i.e., away from the drill machine 43. The jaws 12 are caused to open by the force of helicoidal conical spring 14 when the spindle threads 17*e* pass through the drive piece threads 21*e* and the spindle 17 moves away from the drill machine 43. Now the rivet mandrel 52 can be removed from the universal riveter 40 or 42 by inclining the universal riveter 40 or 42 so that gravity causes the rivet mandrel 52 to dropout. At this point the riveting process can be repeated with another rivet 50.

The second embodiment for the universal riveter 42 of the invention is attached to a drill chuck 44 in combination with a hexagonal drill bit adapter 28 (see FIGS. 5, 6, 7 and 16). Hexagonal drill bit adapters 28 can be used to retain drill bits 46 or other tools.

Figure 15:
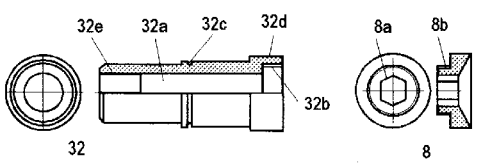
Figure 16:
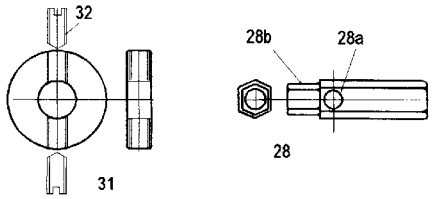

To attach the universal riveter 42 to a drill chuck 44 with a hexagonal drill bit adaptor 28, the magnetized internal hexagon 8 (see FIGS. 15 and 18) is placed so that the hexagonal hole 8*a* its over the hexagonal drill bit adaptor 28 (see FIG. 6) and the magnetized internal hexagon 8 holds the universal riveter 42 against the hexagonal drill bit adapter 28 which in turn is held in the drill chuck 44. As so arranged a drill bit 46 held in the hexagonal drill bit adaptor 28 or other tool if present will fit without obstruction into cavity 32*a* of the drive piece 32 (see FIGS. 15 and 18) so that the tool can pass into the universal riveter 42 and thus be safely stored out of the way. Again this second embodiment of the universal riveter 42 as so mounted to a drill machine 43 can be hand held by the body 2 as can the first embodiment of the universal riveter 40 discussed above.

Drive piece 32 with drive piece threads 32*e* and helicoidal spring 19 function with respect to spindle 17 and spindle threads 17*e* identically to drive piece 21 and its threads 21*e* for the first embodiment of the universal riveter 40 as is discussed above. Therefore, mounting of a rivet mandrel 52 in the universal riveter 42, then riveting with such a mounted rivet 50 and finally extracting a severed rivet mandrel 52 from a universal riveter 42 are identical processes to those for a universal riveter 40. The differences are in the attachments of a universal riveter 40 embodiment or a universal riveter 42 embodiment to a drill chuck 44.

The above discussion and related illustrations of the present invention are directed primarily to preferred embodiments and practices of the invention. However, it is believed that numerous changes and modifications in the actual implementation of the concepts described herein will be apparent to those skilled in the art, and it is contemplated that such changes and modifications may be made without departing from the scope of the invention as defined by the following claims.

What is claimed is:

1. A universal riveter for attachment to reversible drill machines, the universal riveter usable to form double winged hollow rivets, the universal riveter comprising:

a multipart telescopic housing including:

(i) an exterior body means that an user of the universal riveter can grip by hand for positioning the universal riveter, said exterior body means not being rotatable in response to rotational power provided to the universal riveter by an attached reversible drill machine;

(ii) an interior housing means for containing both (a) a drive piece means for connecting said universal riveter to a chuck portion of the reversible drill machine so that rotational power provided by the reversible drill machine rotates said drive piece means within said interior housing means, and (b) a spindle means for moving an interior grip means connected to said spindle means within said interior housing means to pull a rivet mandrel retained by said interior grip means so that a rivet ball head at the end of the rivet mandrel forms a rivet sleeve having one rivet wing into a double winged hollow rivet as said interior grip means pulls the rivet ball head against the rivet sleeve, said spindle means is restrained by said interior housing means from rotating within said interior housing means in response to rotational power provided to said drive piece means by the reversible drill machine, said exterior body means mounted on the outside of said interior housing means so that said exterior body means can be axially moved along a length of said interior housing means, said interior housing means not being rotatable in response to rotational power provided to said drive piece means by the reversible drill machine; and (iii) a spring means positioned between said exterior body means and said interior housing means for opposing axial movement of said exterior body means with respect to said interior housing means;

wherein said telescopic housing can be opened by axial displacement of said exterior body means to move a portion of said interior housing means out of said exterior body means to permit connection of a portion of said drive piece means to the chuck of the reversible drill machine, and said telescopic housing can be closed by having forces provided by said spring means move said exterior body means to cover said drive piece means extending out from said interior housing means.

2. A universal riveter according to claim 1, further including an exterior longitudinal projection extending as one end of said drive piece means, said drive piece means being aligned and retained in said interior housing means so that a threaded end of said drive piece means that is opposite said exterior longitudinal projection can be threaded onto a threaded end of said spindle means that is also aligned and retained in said interior housing means, and said exterior longitudinal projection of said drive piece means being oriented so as to be uncovered when said exterior body means is axially moved to open said telescopic housing, wherein said exterior longitudinal projection of said drive piece means can be positioned into the chuck of the reversible drill machine and retained by the chuck to attach the universal riveter to the reversible drill machine.

3. A universal riveter according to claim 1, further including a magnetized open ended internal hexagon extending as one end of said drive piece means, said drive piece means being aligned and retained in said interior housing means so that a threaded end of said drive piece means that is opposite said magnetized open ended internal hexagon can be threaded onto a threaded end of said spindle means that is also aligned and retained in said interior housing means, and said magnetized open ended internal hexagon of said drive piece means being oriented so it is uncovered when said exterior body means is axially moved to open said telescopic housing, wherein said magnetized open ended internal hexagon of said drive piece means can be positioned onto a drill bit adaptor means having an external hexagon shaped portion at one end, said drill bit adaptor means being fixed in the chuck of the reversible drill machine so that the universal riveter is attached to the reversible drill machine when said magnetized open ended internal hexagon of said drive piece means is positioned onto said external hexagon shaped portion of said drill bit adaptor means.

4. A universal riveter according to claim 1, in which said interior housing means has an hexagonal cavity section into which one end of said spindle means having an hexagonal shaped exterior portion fits, whereby said spindle means can not rotate with respect to said interior housing means.

5. A universal riveter according to claim 1, further including:

(i) a means affixed at one end of said interior housing means for stopping the movement into said interior housing means of said interior grip means;

(ii) said interior grip means including, (a) a nut means affixed onto said spindle means for containing a jaw holder means, (b) at least three jaw means positioned in said jaw holder means for retaining said rivet mandrel, and (c) a jaw spring means for centering and forcing said jaw means into said jaw holder means.

* * * * *